US011280139B2

(12) United States Patent
Dziekonski

(10) Patent No.: US 11,280,139 B2
(45) Date of Patent: Mar. 22, 2022

(54) SHEARABLE RISER SYSTEM AND METHOD

(71) Applicant: Mitchell Z. Dziekonski, Stafford, TX (US)

(72) Inventor: Mitchell Z. Dziekonski, Stafford, TX (US)

( * ) Notice: Subject to any disclaimer, the term of this patent is extended or adjusted under 35 U.S.C. 154(b) by 0 days.

(21) Appl. No.: 17/169,692

(22) Filed: Feb. 8, 2021

(65) Prior Publication Data

US 2021/0164298 A1 Jun. 3, 2021

Related U.S. Application Data

(63) Continuation of application No. 15/885,010, filed on Jan. 31, 2018, now Pat. No. 10,914,125.

(60) Provisional application No. 62/464,031, filed on Feb. 27, 2017.

(51) Int. Cl.

| | |
|---|---|
| ***E21B 17/01*** | (2006.01) |
| ***E21B 43/013*** | (2006.01) |
| ***E21B 33/03*** | (2006.01) |
| ***E21B 33/038*** | (2006.01) |
| ***E21B 17/06*** | (2006.01) |

(52) U.S. Cl.
CPC ..... *E21B 17/01* (2013.01); *E21B 17/06* (2013.01); *E21B 33/03* (2013.01); *E21B 33/038* (2013.01); *E21B 43/013* (2013.01)

(58) Field of Classification Search
CPC ..... E21B 17/01; E21B 17/06; E21B 33/03; E21B 33/038; E21B 43/013
See application file for complete search history.

(56) References Cited

U.S. PATENT DOCUMENTS

| | | | |
|---|---|---|---|
| 2,328,856 | A | 9/1943 | Stone |
| 3,047,313 | A | 7/1962 | Bruce |
| 3,167,137 | A | 1/1965 | Humphrey |
| 4,188,156 | A | 2/1980 | Fisher et al. |
| 7,662,251 | B2 | 2/2010 | Salama et al. |
| 8,555,981 | B2 | 10/2013 | Edwards et al. |
| 8,997,877 | B2 | 4/2015 | Waldron et al. |
| 9,169,699 | B2 | 10/2015 | Rytlewski |
| 9,683,413 | B1 | 6/2017 | Smith |
| 2004/0086341 | A1 | 5/2004 | Salama et al. |
| 2005/0063788 | A1 | 3/2005 | Clausen |
| 2006/0188342 | A1 | 8/2006 | Salama et al. |
| 2008/0302535 | A1 | 12/2008 | Barnes |
| 2012/0037377 | A1 | 2/2012 | Walker |
| 2012/0043090 | A1 | 2/2012 | Persson et al. |

(Continued)

FOREIGN PATENT DOCUMENTS

WO 1997/006341 A1 2/1997

OTHER PUBLICATIONS

Notice of Acceptance for AU Application No. 2018225291 dated Apr. 6, 2021, 3 pages.

*Primary Examiner* — Aaron L Lembo
(74) *Attorney, Agent, or Firm* — Fletcher Yoder, P.C.

(57) ABSTRACT

A riser for a subsea well comprises a first riser section that may be similar to conventional risers in design and material specifications. A second riser section comprises a passive fracture section that is specifically designed to shear or fracture under design conditions, such as extreme events (e.g., extreme weather or waves, loss of control of a rig or vessel, a rig or vessel moving from a desired position). The passive fracture section is designed to fracture first to prevent or minimize damage to other well equipment, such as at the seabed.

17 Claims, 3 Drawing Sheets

(56) References Cited

U.S. PATENT DOCUMENTS

| | | | |
|---|---|---|---|
| 2014/0311749 | A1 | 10/2014 | Kongshem |
| 2015/0285010 | A1 | 10/2015 | Møgedal et al. |

SHEARABLE RISER SYSTEM AND METHOD

CROSS-REFERENCE TO RELATED APPLICATIONS

This application claims priority from and the benefit of U.S. patent application Ser. No. 15/885,010, entitled "Shearable Riser System and Method," filed Jan. 31, 2018, which claims priority from and the benefit of U.S. provisional application No. 62/464,031, entitled "Shearable Riser System and Method," filed Feb. 27, 2017, which is hereby incorporated by reference in its entirety.

BACKGROUND

The invention relates generally to riser structures used in marine oil and gas applications.

BRIEF DESCRIPTION

The development of technologies for exploration for and access to minerals in subterranean environments has made tremendous strides over past decades. While wells may be drilled and worked for many different reasons, of particular interest are those used to access petroleum, natural gas, and other fuels. Such wells may be located both on land and at sea. Particular challenges are posed by both environments, and in many cases the sea-based wells are more demanding in terms of design and implementation. Subsea wells tend to be much more costly, both due to the depths of water beneath which the well lies, as well as for the environmental hazards associated with drilling, completion, and extraction in sensitive areas.

In subsea applications, a drilling or other well servicing installation (such as a platform or vessel) is positioned generally over a region of the sea floor, and an tubular structure extends from the installation to the sea floor. Surface equipment is position at the location of the well to facilitate entry of the tubular into the well, and to enable safety responses in case of need. As the well is drilled, a drill bit is rotated to penetrate into the earth, and ultimately to one or more horizons of interest, typically those at which minerals are found or anticipated. The tubular structure not only allows for rotation of the bit, but for injection of mud and other substances, extraction of cuttings, testing and documenting well conditions, and so forth.

During the various stages of drilling, intervention, completion and production, riser structures are commonly used that extend between the vessel or platform and equipment at the seabed. Such risers may be designed to bend and flex. In extreme conditions, however, the risers may transmit forces to the equipment on the sea floor that can cause severe damage to the equipment. Such extreme conditions or events may include, for example, the loss of control of the vessel or platform, extreme weather conditions, extreme wave events, and so forth. There has been little or no significant innovation in the art to address such events.

There is a need, therefore, for improvements in the field that may allow risers that can avoid damage to subsea equipment in case of an extreme event.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
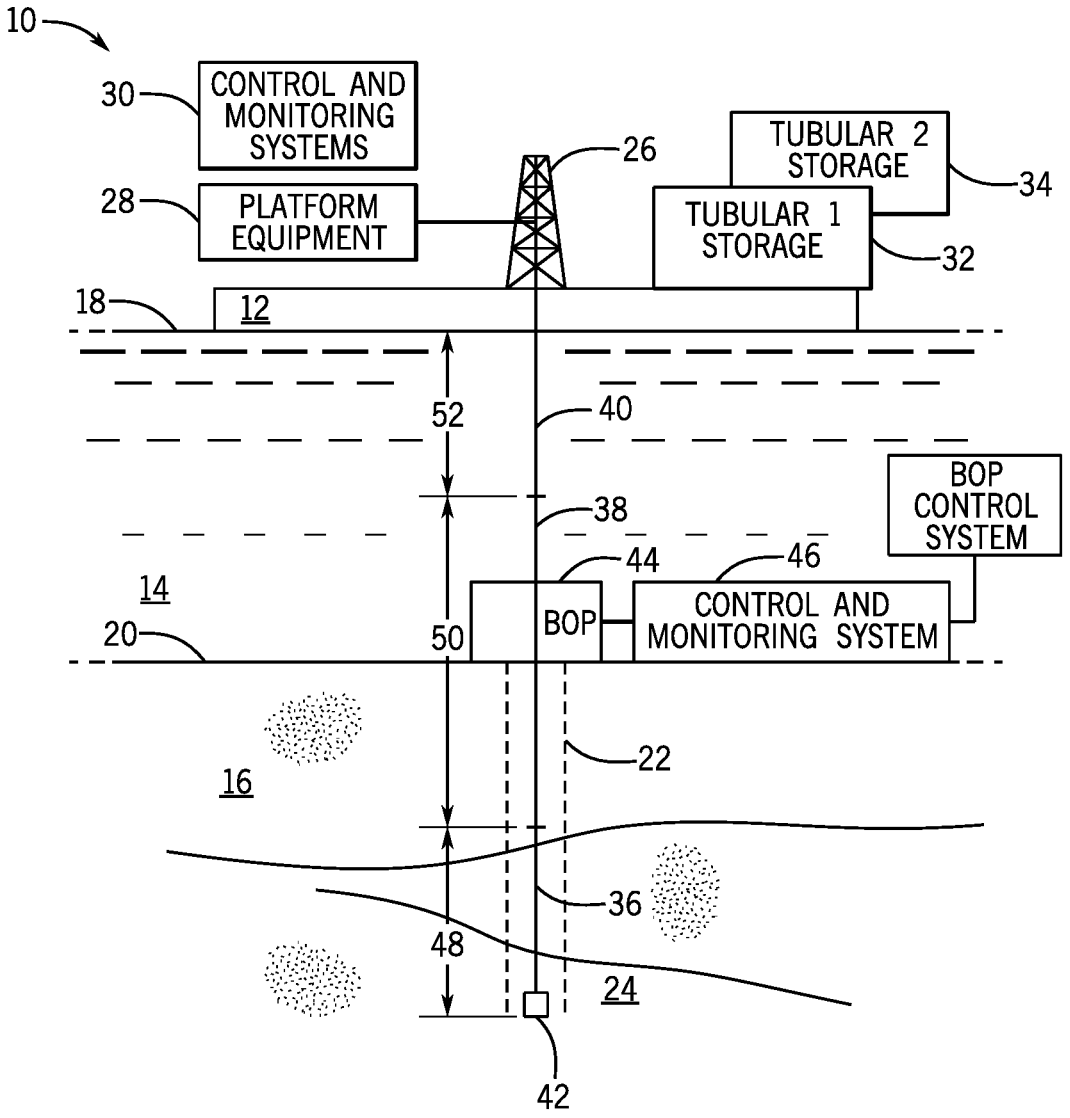
FIG. 1 is a diagrammatical representation of an exemplary installation for drilling, completing, or servicing a subsea well in accordance with the present techniques.

Turning now to the drawings, and referring first to FIG. 1, a well system is illustrated and designated generally by the reference numeral 10. The system is illustrated as an offshore operation comprising a vessel or platform 12 that would be secured to, anchored, moored or dynamically positioned in a stable location in a body of water 14. In FIG. 1, the underlying ground or earth 16 (in this case the seabed) is illustrated below the platform, with the surface of the water designated by the reference numeral 18, and the surface of the earth by reference numeral 20. The platform will typically be positioned near or over one or more wells 22. One or more subterranean horizons of interest 24 will be penetrated or traversed by the well, such as for probing, extraction, accessing or otherwise servicing, depending upon the purpose of the well. In many applications, the horizons will hold minerals that will ultimately be produced form the well, such as oil and/or gas. The platform may be used for any operation on the well, such as drilling, completion, workover, and so forth. In many operations the installation may be temporarily located at the well site, and additional components may be provided, such as for various equipment, housing, docking of supply vessels, and so forth (not shown).

In the simplified illustration of FIG. 1, equipment is very generally shown, but it will be understood by those skilled in the art that this equipment is conventional and is found in some form in all such operations. For example, a derrick 26 allows for various tools, instruments and tubular strings to be assembled and lowered into the well, traversing both the water depths underlying the platform, and the depth of penetration into the well to the horizons of interest. Platform equipment 28 will typically include drawworks, a turntable, generators, instrumentations, controls, and so forth. Control and monitoring systems 30 allow for monitoring all aspects of drilling, completion, workover or any other operations performed, as well as well conditions, such as pressures, production, depths, rates of advance, and so forth.

In accordance with the present disclosure, at least two different tubular stocks are provided and used by the operation, and these may be stored on a deck or other storage location. In FIG. 1 a first of these is designated tubular 1 storage 32, and the second is designated tubular 2 storage. As will be appreciated by those skilled in the art, such tubular products may comprise lengths of pipe with connectors at each end to allow for extended strings to be assembled, typically by screwing one into the other. The two different tubular stocks are used here to allow the operation to balance the technical qualities of each against their costs. That is, one material may be selected for its relative strength but lower cost (e.g., steel), while the other is selected based upon its superior ability to be sheared in case of need, although it may be more costly than the first material. In presently contemplated embodiments, this second tubular stock may comprise titanium alloys, aluminum alloys, but possibly also certain composite materials. As discussed below, the operation judiciously selected which material to use based upon the likelihood that it may be necessary to shear or allow fracture of the overall string. In the illustrated embodiment, the string comprises a riser thought which other tubulars, tools, fluids and so forth may pass between a vessel, platform, rig, ship, or other structure at or near the sea surface and equipment at the seabed.

In the illustration of FIG. 1, a first or lower tubular section 36 has been assembled and deployed in the well, and is connected to a tubular riser section 38 above that forms the riser. A further riser section 40 has been assembled and connected above the lower riser section and extends to the platform. In practice, the upper riser section may be made of the first tubular material while the lower riser section is made of the second tubular material. The riser sections may comprise any suitable length of tubular products, and these will depend upon a number of factors, but typically the location of the horizon of interest (e.g., its depth or for wells having off-vertical sections, the distance to the location of interest), the depth of the water, and the anticipated location of potentially problematic regions where it may be necessary to permit fracture of the riser. In the illustration of FIG. 1, a tool 42 of some sort is located at the bottom of (or along) the string. In drilling operations, for example, this tool will include a drill bit, although those skilled in the art will recognize that many different tools may be used, including those used for instrumentation, evaluation, completion, production, reworking of sections of the well, and so forth.

To allow the string to be sheared in case of need, a blow out preventer 44 is located, typically at the earth's surface 20, and possibly in conjunction with other equipment, such as hydraulic systems, instrumentation, valving, and so forth. Control and monitoring components or systems 46 (including a BOP control system) will typically be associated with the blow out preventer (BOP) to allow for actuation when needed. Those skilled in the art will recognize that such equipment typically provides shear blades that are in generally opposed positions and can be urged towards one by strong hydraulic rams once the BOP is actuated. Actuation of the BOP is an unusual but critical event, and is typically performed only when well conditions absolutely necessitate it, such as when excessive pressures are detected from the well. For safety reasons it is important that the BOP reliably shear the string to seal the well.

The marine riser referred to above may comprise large diameter, temporary conductor pipe that is installed between the subsea wellhead and a floating rig, platform, vessel, or other marine installation. Sections of the marine riser may typically be 40-50 feet in length (although any desired length may be used), and may be assembled by any suitable connections, such as flange-type interconnection. The overall length of the marine riser assembly may be dependent upon a number of factors, such as the water depth, draft of the rig, platform, vessel or installation, height of the subsea wellhead about the subsea mudline, and the anticipated deployed shape of the riser (e.g., to permit some movement, bending, and so forth.

Because the rig cannot always be directly positioned above the subsea wellhead (due to such factors as wind, waves, and currents) the lower end of the marine riser has a flexible connection with the subsea wellhead package to allow some angular movement while still containing fluid and pressure. If an emergency situation occurs, that is, in the event of an extreme condition, the marine riser system may permit disconnection from the subsea wellhead. In such events, the rig, vessel, platform or installation may move off location. Failure to disconnect the marine riser from the subsea wellhead may result in excessive bending loads being transferred to the subsea wellhead and the associated equipment, and the potential for the subsea wellhead and equipment to be broken off in, potentially resulting in loss of well control.

The present techniques allow for fracture or shearing of the riser, such as in case of an extreme condition. The techniques allow for such fracture of shearing to be localized in a predetermined, desired section or sections along the riser. The location may be in a lower section of the riser as described above, in an upper section of the riser, or at more than one location.

In a presently contemplated embodiment, the subsea equipment may include a marine riser disconnect system that may be manually operated. If the rig, platform, vessel or installation moves from its normal operating position, certain factors or considerations may reduce the probability of disconnect, that is, may render the existing disconnect system unworkable or unreliable. For example, with the rig off location this induces high bending loads through the marine riser, and increases friction within the connector mechanism. This can drive a malfunction of the marine riser disconnect system. Also, control lines that send electrical and hydraulic signals to marine riser disconnect system can be damaged by extreme bending conditions.

In accordance with the present techniques, the riser comprises at least one section that is intended to localize fracture or shearing of the riser. This planned fracture section may protect the overall riser and the subsea equipment (and equipment on the rig, vessel, platform or installation) by permitting fracture or shearing of the planned fracture section. In presently contemplated embodiments, the riser comprises one or more special tubular sections to provide a passive fracture section in the marine riser. Once this section of riser reaches a certain level of bending load, tensile load, compressive load, or any combination, the passive fracture section will separate and disconnect. In these embodiments this is accomplished due primarily to the design and/or metallurgy of the passive fracture section.

Figure 2:
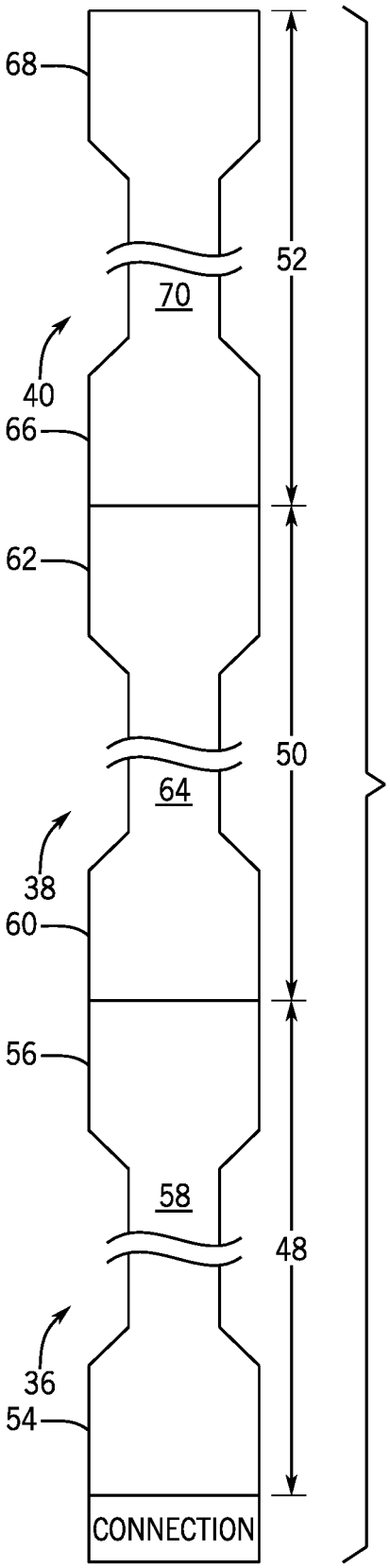
FIG. 2 is a diagrammatical representation of a sections of a tubular riser extending from a platform or vessel to the location of a well, and into the well to a horizon of interest.

By way of example, it is presently contemplated that riser sections may be made of different materials that are stocked on the rig, vessel, platform or installation as tubulars, and assembled to form the desired riser including the passive fracture section. The passive fracture section may be made of one or more materials that are more easily fractured or sheared in case of an extreme condition, such as titanium alloys, aluminum alloys, or composite materials. The strings are assembled as illustrated generally in FIG. 2. A lower riser section 38 is first assembled, typically with a riser connection attached at its lower end. The lower riser section 38 may comprise multiple lengths of pipe, tubing, or any suitable tubular sections 58 with connectors 54 and 56 added to or formed at each end. The length of this riser section will typically be determined by well engineers based upon knowledge of the well conditions, the depth of water, the subsea equipment, and anticipated occurrence of extreme conditions that may make permitted fracture of the riser section beneficial, such as to protect the well equipment. It may comprise, for example, many sections of standard length (e.g., 40 foot sections). The second tubular riser section 38 similarly comprises multiple sections 64 each having connectors 60 and 62. The length 50 of this assembly will be selected so that during use the riser may remain connected between the rig, platform, vessel or installation, and allowed to move or flex in desired ways. One or more upper riser sections 40 similarly comprises multiple section 70 with connectors 66 and 68 along its length 52.

The materials of each riser section may be designed or selected to provide required tensile strengths, internal pressure ratings, and end connections to allow for ready assembly and servicing of the well in the particular conditions then present, and to withstand shear, bending, tensile, and compressive loading on the riser. The materials may, of course, be prepared, heat treated, and so forth, to enhance their strength and material properties (e.g., tensile and hoop strengths). One or more of the sections comprises a passive fracture section designed to part in case of extreme conditions.

In presently contemplated embodiments, the marine riser passive fracture section may be installed directly above a lower marine riser package (LMRP). The passive fracture section is designed with a comparable tensile strength, internal pressure rating, and end connection design as the adjacent marine riser. The outer diameter and inner diameter of the passive fracture section may be similar or the same as the other sections of the overall riser to facilitate common use of rig pipe handling equipment, and compatibility with any plugs or equipment that may be run inside the riser and the passive fracture section.

Regarding the composition of the riser and the passive fracture section, as noted above, lengths of the overall riser and of the passive fracture section may be different and depend upon the job specific functional requirements. Moreover, while it is contemplated that the passive fracture section may be best situation in a lower riser section (e.g., adjacent to the equipment on the seabed), one or more such sections may be provided at different locations in the riser, and where more than one is provided, the passive fracture sections may be different (e.g., designed to fracture under different conditions, at different loads, for different reasons, and forth).

The passive fracture section may comprise materials and preparations based upon the unique properties desired. In presently contemplated embodiments, for example, the passive fracture section or sections may be made of aluminum, titanium, ductile-iron, and carbon-fiber materials where these materials are processed (assembled, or heat-treated) using a process to maximize tensile and hoop strength properties, while increasing the capacity of these same materials to shear or fracture under certain loading conditions, such as bending. Thus, unlike traditional steel marine risers where with increased tensile and hoop strengths, the steel will also obtain increased shear stress strength. Here again, as noted, one or more passive fracture sections can be placed anywhere within the marine riser, although it may be advantageous to install this in the lower portion of the marine riser directly above the LMRP to prevent excessive bending moment transmission to the subsea wellhead in the event of "dropping" the marine riser, or rig moving off location.

The passive fracture section is designed to "fail" (that is, to shear or facture to separate the riser at the point of fractrure) at a preset load (e.g., bending or a combination of loading) that should only be encountered contemplated extreme conditions. The term "passive" in the context of the fracture section is intended to convey that the section does not require manual activation to operate, thus providing redundancy to the LMRP disconnect package.

Figure 3:
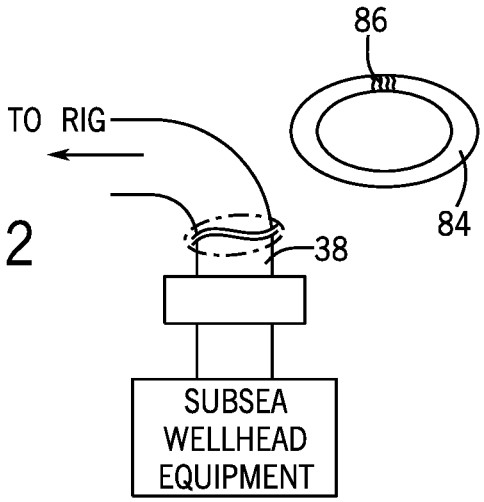
FIG. 3 is a diagrammatical representation of permitted fracture of the riser in case of an extreme event.

The choice of corrosion resistant materials for the passive fracture section may improve the reliability of the "failure" and disconnect mechanisms within this section. As illustrated in FIG. 3, for example, it is contemplated that as the walls 84 of the tubular forming the passive fracture section are deformed, cracking is initiated, as indicated by reference numeral 86. Energy is effectively stored in the material during deformation, and this energy is released to both initiate and to promote the cracking, resulting in rapid shearing, typically at much lower levels of force than conventional materials.

The material properties believed to be of particular interest in allowing for reliable shearing or fracturing of the passive fracture section of the riser include yield and tensile strengths and their relative relationships to one another, modulus of elasticity, fracture toughness, and tendancy, based upon these properties, of cracks to propagate quickly. Regarding, first, the strength of the materials, for steel alloys a typical strength yield strength may be on the order of approximately 100 KSI, although this may range, for example between 65 to 125 KSI yield strength range. Tensile strengths for such steel materials may range typically between 20 to 30 KSI higher than the yield strength. A ratio of yield strength to tensile strength may be, therefore, on the order of 0.8 to 0.85. Titanium alloys suitable for the present techniques, on the other hand, have yield strengths typically on the order of 140 KSI, with typical ranges of 75 to over 160 KSI. The tensile strengths of these materials, however, is only approximately 10 KSI above the yield strength, resulting in a substantially higher ratio of on the order of above 0.90. Similarly, aluminum alloys suitable for use in the present techniques will typically have a yield strength on the order of approximately 58 KSI with ranges of 40 to 75 KSI. Typical tensile strengths would be on the order of approximately 63 KSI with ranges of 46 to 81 KSI, resulting in a difference between the yield strength and the tensile strength of only approximately 6 KSI, and a ratio of yield strength to tensile strength of higher than 0.90. Composites are unique in that they can be manufactured to meet any of the requirements for optimum shearability, with very narrow ranges and differences between the yield strength and the tensile strength.

Regarding the modulus of elasticity, conventional steels used for well tubulars have a modulus typically on the order of 29.5 Mpsi, with typical ranges of 27 to 31 Mpsi. Titanium tubulars contemplated for the present techniques, on the other hand, have a modulus typically on the order of 16.5 million psi, with typical ranges of 13.5 to 17 Mpsi. That is, significantly lower than that of steel tubulars. Aluminum alloy tubulars suitable for the present techniques have a modulus typically on the order of 10 Mpsi. Ranges 9 to 11.5 Mpsi. Suitable composites can be made to have a very low modulus, such as on the order of 5 Mpsi if required.

Regarding the fracture toughness, this property may be defined the ability of a material containing a crack to resist fracture. The value indicates the stress level that would be required for a fracture to occur rapidly. Typical steels used for well tubulars may have a fracture toughness on the order of 100 $KSIin^{-2}$, with ranges of approximately 65 to 150 $KSIin^{-2}$. Titanium tubulars contemplated for the present techniques, on the other hand have fracture toughness valued on the order of approximately 45 $KSIin^{-2}$, with ranges of approximately 35 to 70 $KSIin^{-2}$. Suitable aluminum tubulars have a fracture toughness typically on the order of approximately 35 $KSIin^{-2}$. Here again, composite tubulars may be made to have very low fracture toughness valued, similar to those mentioned for titanium and aluminum alloys.

As noted above, the sections of the riser, and indeed the riser itself may be selected depending upon the application parameters, and the purpose of the riser. For example, riser can comprise a drilling riser, a subsea intervention riser, a completion riser or a production riser. The passive fracture section may then be considered a type of safety joint above the wellhead that is intentionally designed to shear or fracture under severe loading in an extreme event to prevent or to minimize damage to other equipment and systems.

Regarding the tendancy for rapid crack propagation, this may be considered to result from stored energy in the material during deformation, and from the other characteristics discussed above. As noted, the tubulars contemplated for the passive fracture section, will typically be deformed, but with cracks initiating in multiple locations, such as where the material is bent or crushed at opposite sides. Essentially then, owing to the strength values (particularly the relatively smaller difference between the yield strength and the tensile strength), the lower modulus of elasticity, and the lower fracture toughness, the proposed passive fracture section may tend to store significant energy during deformation, that is released to cause very rapid propagation of the initiated cracks.

Regarding the specific materials that may be used, presently contemplated titanium tubulars may be selected from the so-called Alpha Beta and Beta families. Suitable aluminum tubulars may be selected, for example, from 2000, 6000, and 7000 series. Suitable composites may include carbon fiber compositions.

Figure 4:
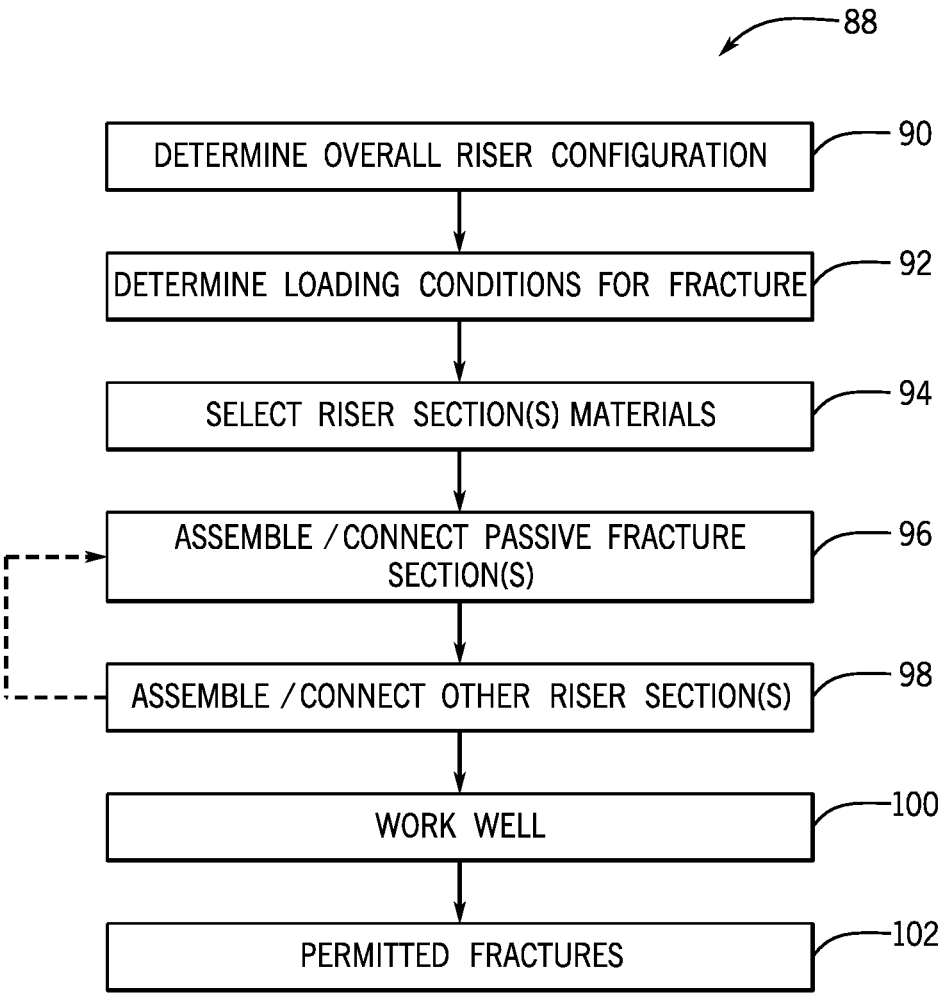
FIG. 4 is a flow chart illustrating exemplary steps in implementation of the present techniques.

FIG. 4 is a flow chart illustrating exemplary logic 88 for performing the method of assembling the tubulars of the riser discussed above, and permitted fracturing of the passive fracture section. As indicated by reference numeral 90, the overall configuration of the riser is determined, such as based on such factors as the depth of the water in which the well is located, the equipment used, the type and positioning of the rig or vessel, the use or purpose of the riser, the permitted movement or deformation of the riser, and so forth. Next, the anticipated loading of the riser is determined, as indicated at step 92. It should be noted that this step may particularly focus on the "normal" or anticipated loading (e.g., shear, bending, tensile, compression, or combinations of these) during operation of the riser. At this stage, also, unusual loading conditions, and threshold loading for permitted fracture of the passive fraction section are determined. Based upon these conditions and loading, then, the materials for the riser and for the passive fractures section are selected, as indicated at step 94.

The riser is then assembled to include the selected materials. This assembly will include assembly (e.g., handling, connection, and deployment) of the passive fracture section, at step 96, and assembly of the other sections of the riser, at step 98. It may be noted that the dashed line in FIG. 4 is intended to indicate that more than one passive fracture sections may be used, and these may be interspersed with sections of the base riser material. Here again, where more than one passive fracture sections are used, these may be the same or different, such as to allow for fracturing at different types of degrees of loading.

At step 100, then the riser is used for its intended purpose, such as for drilling, completion, production, and so forth. During this normal usage, the loading on the riser will typically be below the loading required for fracture of the passive fracture section or sections. However, in the event of an extreme condition, the loading will exceed the design loading of the one or more passive fracture sections and fracture will occur. Protocols may then allow for reworking or reconnection to the well equipment once the conditions have passed.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method, comprising:

assembling a riser to extend between a vessel and a subsea well location, the riser comprising a first riser section made of a first material and a second riser section made of a second material different from the first material, the second riser section comprising a passive fracture section that fractures passively under design loading that will not cause fracture of the first riser section, the second riser section being installed above a lower marine riser package;

utilizing the assembled riser during normal operating conditions; and permitting passive fracture of the passive fracture section under design conditions that exceed the design loading;

wherein the passive fracture section comprises a single wall tubular structure having a wall in which cracking initiates that is promoted during the passive facture; and wherein the passive fracture section is characterized by a yield strength to tensile strength ratio of at least approximately 0.9, and a fracture toughness of at most approximately 45 $KSIin^{-2}$.

2. The method of claim 1, wherein the passive fracture section comprises a titanium alloy and the first riser section comprises a steel alloy.

3. The method of claim 1, wherein the passive fracture section comprises an aluminum alloy and the first riser section comprises a steel alloy.

4. The method of claim 1, wherein the passive fracture section comprises a composite material and the first riser section comprises a steel alloy.

5. The method of claim 1, wherein the passive fracture section is connected adjacent to seabed well equipment.

6. The method of claim 1, wherein the passive fracture section is characterized by a modulus of elasticity of at most approximately 17 Mpsi.

7. A marine riser comprising:

first riser section made of a first material and extending partially between a vessel and a subsea well location;

a second riser section made of a second material different from the first material and coupled to the first riser section and extending partially between the vessel and the subsea well location, the second riser section being installed above a lower marine riser package, the second riser section comprising a passive fracture section that fractures passively under design loading that will not cause fracture of the first riser section; wherein the passive fracture section comprises a single wall tubular structure having a wall in which cracking initiates that is promoted during the passive facture;

wherein the passive fracture section is characterized by a yield strength to tensile strength ratio of at least approximately 0.9, and a fracture toughness of at most approximately 45 $KSIin^{-2}$.

8. The marine riser of claim 7, wherein the passive fracture section comprises a titanium alloy.

9. The marine riser of claim 8, wherein the first riser section comprises a steel alloy.

10. The marine riser of claim 7, wherein the passive fracture section comprises an aluminum alloy.

11. The marine riser of claim 7, wherein the passive fracture section comprises a composite material.

12. A marine riser comprising:

a riser section made of a material different from other riser sections of the marine riser, and extending partially between the vessel and the subsea well location, the riser section comprising a passive fracture section installed above a lower marine riser package that fractures passively under loading exceeding design loading, wherein the passive fracture section comprises a single wall tubular structure having a wall in which cracking initiates that is promoted during the passive facture; wherein the passive fracture section comprises a titanium allow, an aluminum alloy, or a composite material.

13. The marine riser of claim 12, wherein the passive fracture section comprises a titanium alloy and the another riser section comprises a steel alloy.

14. The marine riser of claim 12, wherein the passive fracture section comprises an aluminum alloy and the another riser section comprises a steel alloy.

15. The marine riser of claim 12, comprising a further riser section extending partially between a vessel and a subsea well location and coupled to the riser section having the passive fracture section and that will not fracture under the design loading.

16. The marine riser of claim 15, wherein the further riser section comprises a steel alloy.

17. The marine riser of claim 12, wherein the passive fracture section is characterized by a yield strength to tensile strength ratio of at least approximately 0.9, a modulus of elasticity of at most approximately 17 Mpsi, and a fracture toughness of at most approximately 45 KSIin-2.

* * * * *